US005234357A

United States Patent [19]

Yamaguchi

[11] Patent Number: 5,234,357

[45] Date of Patent: Aug. 10, 1993

[54] LOCK MECHANISM FOR ELECTRICAL CONNECTOR

[75] Inventor: Masao Yamaguchi, Tokyo, Japan

[73] Assignee: Hirose Electric Co., Ltd., Tokyo, Japan

[21] Appl. No.: 921,395

[22] Filed: Jul. 30, 1992

Related U.S. Application Data

[63] Continuation of Ser. No. 698,104, May 10, 1991, abandoned.

[30] Foreign Application Priority Data

Jul. 4, 1990 [JP] Japan ..... 2-176832

[51] Int. Cl.[5] ..... H01R 13/627

[52] U.S. Cl. ..... 439/354; 439/357

[58] Field of Search ..... 439/345, 347, 350, 351, 439/352, 353, 354, 355, 357, 372

[56] References Cited

U.S. PATENT DOCUMENTS 4,533,889 8/1985 Knight ..... 439/444 X
4,568,135 2/1986 Frantz ..... 439/347 X
4,621,885 11/1986 Szczesny et al. ..... 439/357
4,699,438 10/1987 Kikuta ..... 439/353 X
4,718,857 1/1988 Noschese ..... 439/351 X
4,718,866 11/1988 Yamaguchi ..... 439/607
4,838,810 6/1989 Yoshimura et al. ..... 439/350 X
4,936,793 6/1990 Uchida ..... 439/350
5,021,002 6/1991 Noschese ..... 439/352

OTHER PUBLICATIONS

IBM Technical Bulletin, vol. 20, No. 5, Oct. 1977.

*Primary Examiner*—Larry I. Schwartz
*Assistant Examiner*—Khiem Nguyen
*Attorney, Agent, or Firm*—Kanesaka & Takeuchi

[57] ABSTRACT

A lock mechanism for an electrical connector includes a pair of extended sections (41) each having a lock projection (48) for engagement with a lock hole (5) of a mating electrical connector; a linking arm (44) for connecting said extended sections; a pair of press-fit portions (43) with a metal fitting engaging projection (45) for engagement With a press-fit groove 32) of an insulation housing (30); and a pair of U-shaped sections (42) for connecting said extended sections and said press-fit sections.

2 Claims, 3 Drawing Sheets

LOCK MECHANISM FOR ELECTRICAL CONNECTOR

CROSS-REFERENCE TO RELATED APPLICATIONS

This is a continuing application of Ser. No. 698,104 filed May 10, 1991, now abandoned.

BACKGROUND OF THE INVENTION

1. Field of the Invention

The present invention relates to lock mechanisms for locking the connection of two electrical connectors.

2. Description of the Prior Art

Japanese U.M. patent application Kokai No. 63-172070 discloses a lock mechanism for electrical connectors which includes a pair of separate engaging metal fittings incorporated on the opposite sides of the insulation case of an electrical connector for engagement with the engaging metal fittings of a mating electrical connector for locking the connection of the two electrical connectors. The engaging metal fittings are secured to the insulation case by fixtures on opposite sides, and the engaging portions are provided between these fixtures.

However, the above conventional lock mechanism for electrical connectors has the following disadvantages:

(1) The engaging metal fittings are separated, resulting in the increased numbers of components and assembling steps and thus the increased manufacturing costs.

(2) It is often to forget assembling the other engaging metal fitting after one has been assembled, thus providing a defective product.

(3) Since the engaging metal fittings are separated, it is impossible to make use of the engaging metal fitting receiving portion of only one engaging metal fitting for checking the connection with the mating electrical connector.

(4) Each engaging metal fitting has a pair of fixtures on opposite sides, with the engaging portion between them, resulting in the increased width of an engaging metal fitting and thus the increased thickness (or hight) of the electrical connector.

SUMMARY OF THE INVENTION

Accordingly, it is an object of the invention to provide a thinn and economical lock mechanism for an electrical connector, which is free from a defect resulting from overlook of the other engaging metal fitting and able to perform electrical connection check without difficulty.

According to the invention there is provided a lock mechanism for an electrical connector which includes a pair of extended sections each having a lock projection for engagement with a lock hole of a mating electrical connector; a linking arm for connecting the extended sections; a pair of press-fit portions with a metal fitting engaging projection for engagement with a press-fit groove of an insulation housing; and a pair of U-shaped sections for connecting the extended sections and the press-fit sections.

The above and other objects, features, and advantages of the invention will be more apparent from the following description when taken in conjunction with the accompanying drawings.

DESCRIPTION OF THE PREFERRED EMBODIMENT

Figure 1:
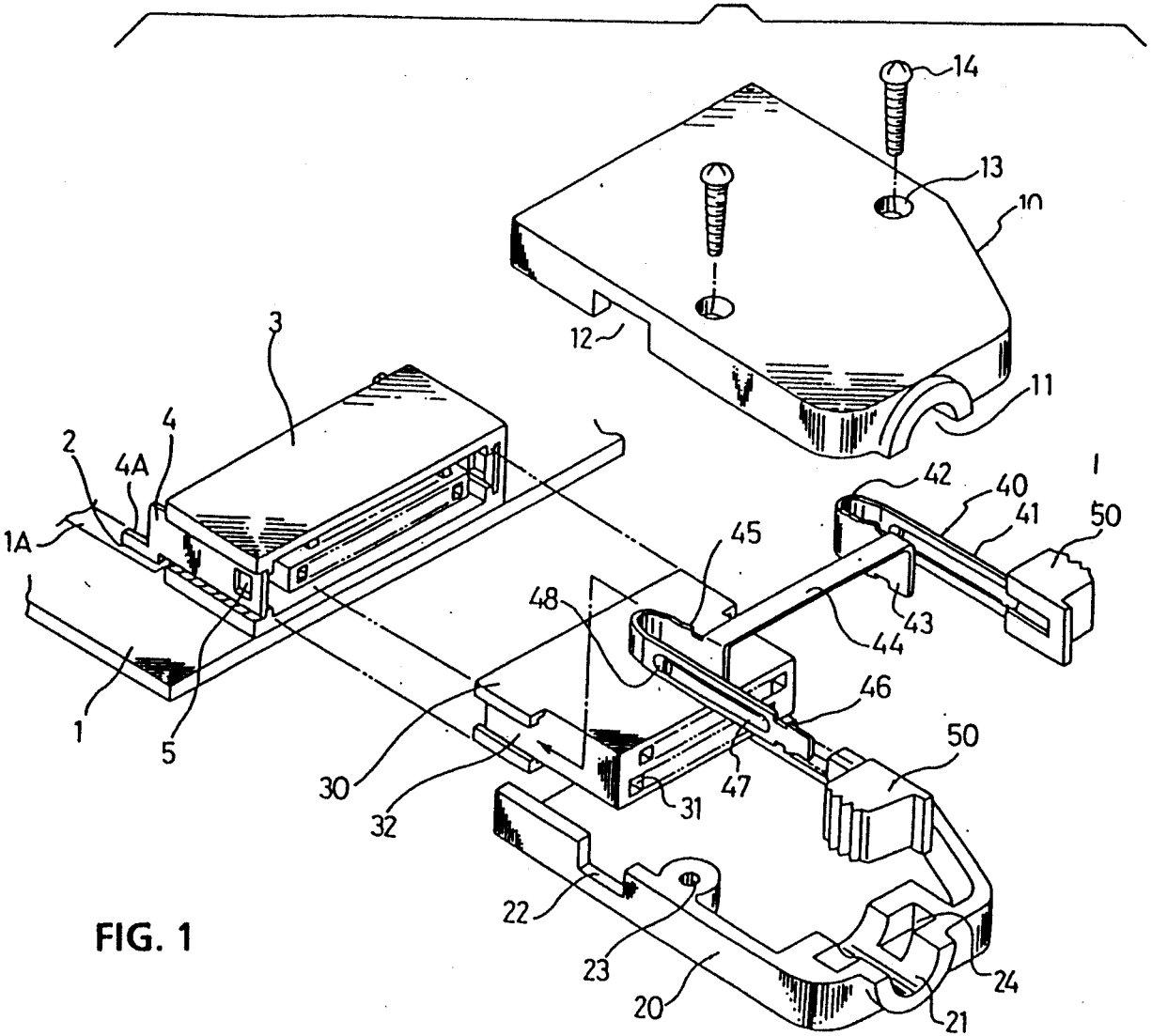
FIG. 1 is an exploded perspective view of a pair of electrical connectors having a lock mechanism according to an embodiment of the invention.

In FIG. 1, an electrical connector includes upper and lower case halves 10 and 11 made from an insulation material, such as a plastic, an insulation housing 30 to be placed in the case, and an engaging metal fitting 40 to be mounted on the insulation housing 30. A mating electrical connector is mounted on a printed circuit board 1, for example, and includes an insulation housing 3 having a number of contacts arranged therein. A pair of engaging metal fittings 4 are mounted on opposite sides of the insulation housing 3. Each metal fitting 4 has an engaging hole 5 at the front portion and a ground extension 4A at the rear portion. The ground extension 4A is soldered at 2 to the ground conductor 1A of the board 1.

The upper case half 10 has at the front portion a receiving cavity for receiving the rear portion of the insulation housing 30 and at the rear portion a cable receiving port 11. A pair of knob openings 12 are formed on opposite side walls of the upper case half 10. A pair of holes 13 are provided on the upper case half 10 for fastening the upper case half 10 to the lower case half 20 with a pair of screws 14.

Similarly to the upper case half 10, the lower case half 20 has a cable receiving port 21 and a pair of knob openings 22. A pair of threaded holes 23 are provided for receiving the fastening screws 14. A cable fixture receiving recess 24 is formed on the cable receiving port 21. A cable fixture receiving recess similar to this is formed on the cable receiving port 11 of the upper case half 10.

The insulation housing 30 is made from an insulation material, such as a plastic, so as to have a number of contact channels 31 for receiving contacts as the insulation housings of ordinary connectors. A pair of press-fit grooves 32 are formed on opposite sides of the front portion of the insulation housing 30.

The engaging metal fitting 40 is made from a springy metal sheet by stamping and forming so as to have a pair of extended sections 41, a pair of press-fit sections 43, a pair of U-shaped sections 42 between the extended sections 41 and the press-fit sections 43, and a linking arm 44 for connecting the press-fit sections 43. The end portion of each extended section 41 is provided with a pair of knob retaining projections 46. An lock projection 48 is stamped out from the front portion of the extended section 41. An inwardly projecting reinforcing rib 47 is provided between the knob retaining projection 46 and the lock projection 48. Each press-fit section 43 has a pair of metal fitting retaining projections 45.

A pair of knobs 50 made from a plastic, for example, so as to have a corrugated top so that it is easy to push for unlocking the connection of two connectors. The knobs 50 have a groove for engaging the knob retaining projections 46 to secure them to the engaging fitting 40.

How to assemble the above electrical connector will be described with reference to FIG. 2. Individual contacts to which the insulated conductors 7 of a multi-conductor cable 6 are secured are inserted into the contact channels 31 of the insulation housing 30. The engaging metal fitting 40 with the knobs 50 is mounted on the insulation housing 30 by press fitting the press-fit sections 43 of the engaging metal fitting 40 into the press-fit receiving grooves 32 of the insulation housing 30 so that the fitting engaging projections 45 wedge into the walls of the receiving grooves 32 while the linking arm 44 rests on one side of the insulation housing 30.

Figure 2:
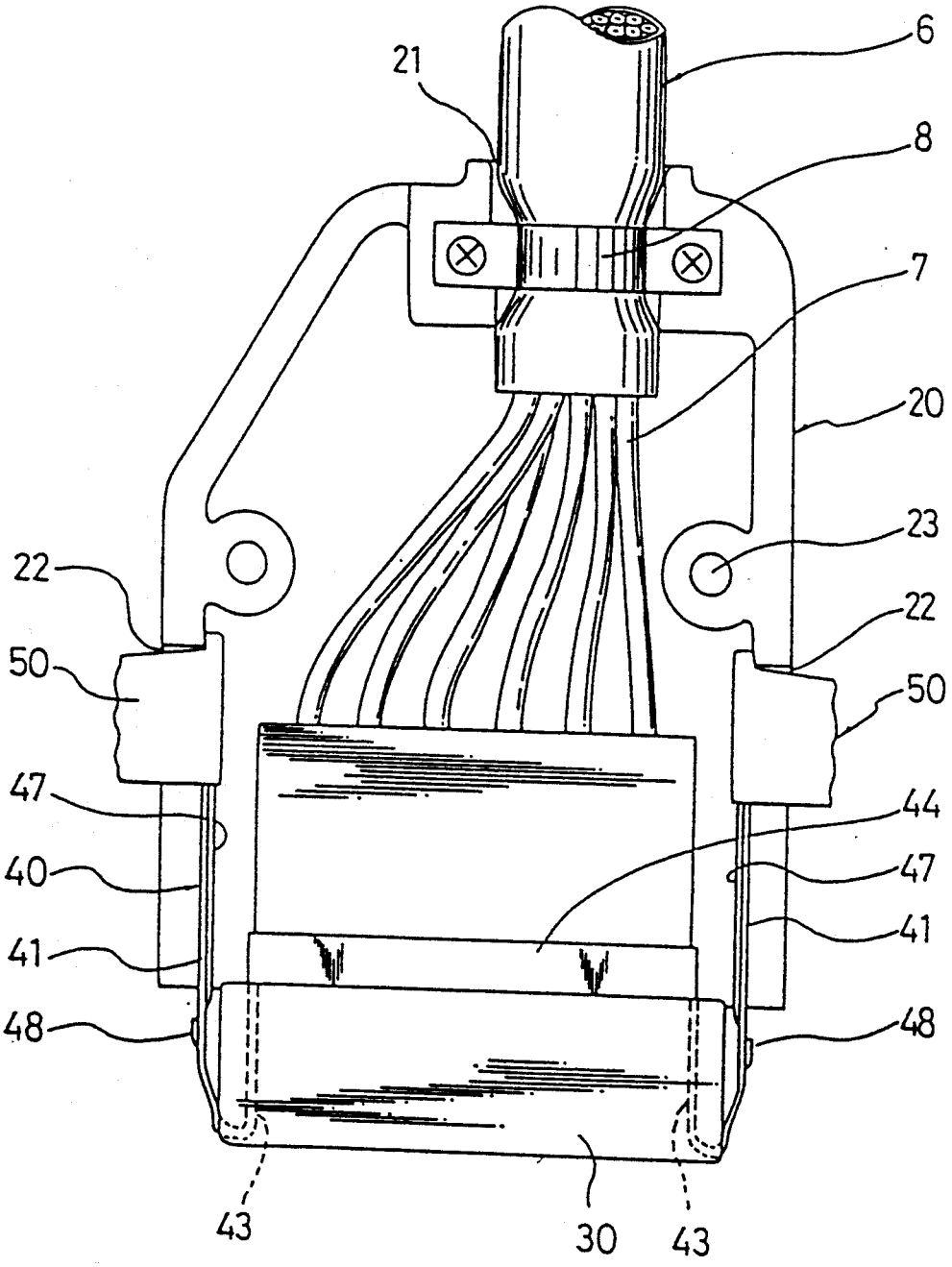
FIG. 2 is a top plan view of an electrical connector from which an upper case half is removed.

As FIG. 2 shows, the insulation housing 30 is placed in the lower case half 20 so that the knobs 50 and the multiconductor cable 6 fit into the knob engaging openings 22 and the cable receiving port 21, respectively, and the multiconductor cable 6 is secured to the cable receiving port 21 with a cable fixture 8. Finally, the upper case half 10 is secured to the lower case half 20 with fastening screws 14.

When the above electrical connector is plugged into the mating connector on the board 1, the extended sections 41 flex inwardly at the U-shaped sections 42 so that respective lock projections 48 of the engaging metal fitting 40 slide on the engaging metal fitting 4 and snap into the lock holes 5, thus locking the connection of the two connectors. In order to unlock the connection, it is only necessary to push the knobs 50 so that the respective extended sections 41 flex inwardly at the U-shaped sections 42, thereby releasing the respective lock projections 48 from the lock holes 5. Thus, the two electrical connectors are separated by pulling one from the other.

Figure 3:
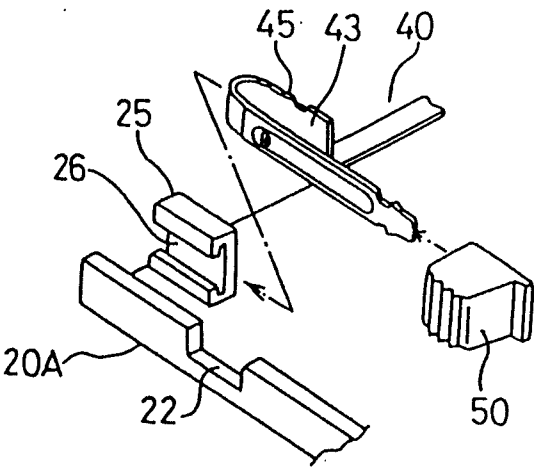
FIG. 3 is a perspective view of a lock mechanism according to another embodiment of the invention.

In the above embodiment, the engaging grooves 32 are formed on the side walls of the insulation housing 30 for receiving the engaging metal fitting 40 to secure the engaging metal fitting 40 to the insulation housing 30. However, as FIG. 3 shows, it is possible to secure the engaging meal fitting 40 to the lower case half 20A by wedging the metal fitting retaining projection 45 into the press-fit grooves 26 of an inner wall 25 which is provided on the lower case half 20A. Alternatively, the engaging metal fitting 40 may be secured to the upper case half in the same way. When the engaging metal fitting 40 is secured to the lower or upper case half instead of the insulation housing 30, it is easy to insert contacts into the insulation housing 30. In addition, the connected cable does not interfere with the attachment of the engaging metal fitting 40.

Figure 4:
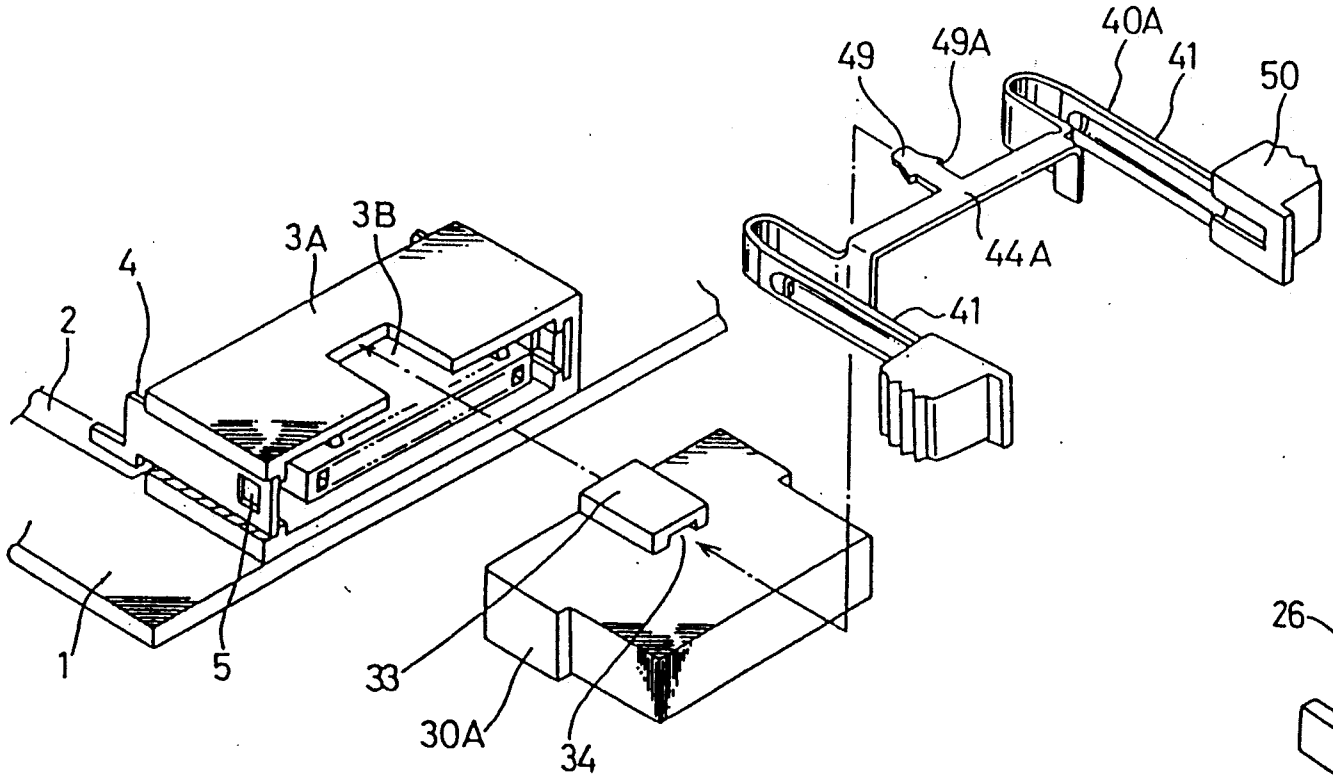
FIG. 4 is an exploded perspective view of a lock mechanism according to still another embodiment of the invention.

In FIG. 4, an engaging metal fitting 40A has a press-fit portion 49 extending from the center of a linking arm 44A. The press-fit portion 49 has a pair of engaging projections 49A. The insulation housing 30A is provided with a guide projection 33 on the central front portion. The guide projection 33 has a press-fit opening 34. By inserting the press-fit portion 49 into the press-fit opening 34, the engaging metal fitting 40A is secured to the insulation housing 30A. The insulation housing 3A of the mating electrical connector is provided with a guide recess 3B for receiving the guide projection 33 of the insulation housing 30A. In this way, it is possible to reduce the width of the insulation housing.

What is claimed is:

1. A lock mechanism for an electrical connector, comprising:

a pair of extended sections each having a lock projection for engagement with a lock hole of a mating electrical connector;

a linking arm for connecting said extended sections;

a pair of press-fit portions with a metal fitting engaging projection;

a pair of U-shaped sections for connecting said extended portions and said press-fit portions; and a pair of inner walls with a press-fit groove provided on opposite sides of a case for receiving said press-fit portions;

said press-fit groove being formed by a pair of upper and lower L-shaped flanges extending rearwardly from front edges of said case.

2. A lock mechanism for an electrical connector with an insulation housing having a pair of press-fit grooves on opposite sides, comprising:

a pair of extended sections each having a lock projection for engagement with a lock hole of a mating electrical connector;

a linking arm for connecting said extending sections;

a pair of press-fit portions each being provided with a metal fitting engaging projection for engagement with said press-fit groove of said insulation housing; and a pair of U-shaped sections for connecting said extended sections and said press-fit portions;

said press-fit grooves being formed by a pair of upper and lower L-shaped flanges extending rearwardly from a mating face along upper and lower surfaces of said insulation housing.

* * * * *